US010337147B2

(12) United States Patent
Rouse et al.

(10) Patent No.: US 10,337,147 B2
(45) Date of Patent: Jul. 2, 2019

(54) HIGHLY DISPERSIBLE HESPERALOE TISSUE

(71) Applicant: Kimberly-Clark Worldwide, Inc., Neenah, WI (US)

(72) Inventors: Kayla Elizabeth Rouse, Appleton, WI (US); Richard Louis Underhill, Neenah, WI (US); David John Paulson, Appleton, WI (US); Felicia Marie Sauer, Greenville, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/816,361

(22) Filed: Nov. 17, 2017

(65) Prior Publication Data

US 2018/0142419 A1 May 24, 2018

Related U.S. Application Data

(60) Provisional application No. 62/425,651, filed on Nov. 23, 2016.

(51) Int. Cl.

| | |
|---|---|
| ***D21H 27/00*** | (2006.01) |
| ***D21H 27/42*** | (2006.01) |
| ***D21H 11/12*** | (2006.01) |
| ***D21H 27/38*** | (2006.01) |
| *D21C 5/00* | (2006.01) |

(52) U.S. Cl.

CPC ..... *D21H 27/005* (2013.01); *D21H 11/12* (2013.01); *D21H 27/002* (2013.01); *D21H 27/38* (2013.01); *D21H 27/42* (2013.01)

(58) Field of Classification Search

CPC .... D21H 27/002; D21H 27/30; D21H 25/005; D21H 27/005; D21H 27/38; D21H 11/12; D21H 11/00; D21H 27/42

See application file for complete search history.

(56) References Cited

U.S. PATENT DOCUMENTS

| | | | | |
|---|---|---|---|---|
| 5,320,710 | A | 6/1994 | Reeves et al. | |
| 6,258,207 | B1 | 7/2001 | Pan | |
| 6,302,997 | B1 | 10/2001 | Hurter et al. | |
| 6,455,129 | B1 | 9/2002 | Kershaw et al. | |
| 6,511,579 | B1 | 1/2003 | Edwards et al. | |
| 7,682,488 | B2 | 3/2010 | Yeh et al. | |
| 8,049,060 | B2 | 11/2011 | Vinson et al. | |
| 8,741,104 | B2 | 6/2014 | Edwards et al. | |
| 10,132,036 | B2 * | 11/2018 | Collins | D21H 27/002 |
| 10,145,066 | B2 * | 12/2018 | Shannon | A47K 7/00 |
| 10,145,069 | B2 * | 12/2018 | Shannon | D21H 27/002 |
| 2002/0148584 | A1 | 10/2002 | Edwards | |
| 2003/0192662 | A1 | 10/2003 | Heath et al. | |
| 2004/0140076 | A1 | 7/2004 | Hermans et al. | |
| 2004/0168780 | A1 | 9/2004 | Dwiggins | |
| 2004/0226673 | A1 | 11/2004 | Edwards | |
| 2005/0236122 | A1 | 10/2005 | Mullally et al. | |
| 2007/0051484 | A1 | 3/2007 | Hermans et al. | |
| 2007/0107863 | A1 | 5/2007 | Edwards | |
| 2008/0008853 | A1 | 1/2008 | Hupp et al. | |
| 2010/0126685 | A1 | 5/2010 | Fike | |
| 2013/0068867 | A1 | 3/2013 | Hermans et al. | |
| 2013/0068868 | A1 | 3/2013 | Hermans et al. | |
| 2013/0071678 | A1 | 3/2013 | Shannon | |
| 2013/0199741 | A1 | 8/2013 | Stage et al. | |
| 2013/0269892 | A1 | 10/2013 | Pawar et al. | |
| 2014/0093704 | A1 | 4/2014 | Shi et al. | |
| 2014/0093705 | A1 | 4/2014 | Shi et al. | |
| 2014/0205777 | A1 | 7/2014 | Hawkins et al. | |
| 2014/0284010 | A1 | 9/2014 | Shannon | |
| 2015/0129143 | A1 | 5/2015 | Hawkins et al. | |
| 2018/0044859 | A1 | 2/2018 | Hermans | |
| 2018/0135248 | A1 * | 5/2018 | Collins | D21H 27/002 |
| 2018/0135249 | A1 * | 5/2018 | Shannon | A47K 7/00 |
| 2018/0135253 | A1 * | 5/2018 | Shannon | D21H 27/002 |

(Continued)

FOREIGN PATENT DOCUMENTS

| | | |
|---|---|---|
| EP | 2 513 372 B1 | 3/2014 |
| GB | 1 374 198 A | 11/1974 |

(Continued)

OTHER PUBLICATIONS

Eugenio et al., in "Evaluation of Hesperaloe funifera pulps obtained by a low energy consumption process as a reinforcement material in recycled pulps," Forest Systems 21(3) pp. 460-467. (Year: 2012).

Hurter, Robert W., in "Nonwood Plant Fiber Characteristics" HurterConsult pp. 1-4 (Year: 2001).

McLaughlin, Steven in "Properties of Paper Made From Fibers of Hesperaloe Funifera (Agavaceae)," Economic Botany, 54(2) pp. 192-196. (Year: 2000).

Deniz et al. in "Kraft and Modified Kraft Pulping of Bamboo (*Phyllostachys bambusoides*)," Drewno 2017, vol. 60, No. 200.

Protasio et al. in "Brazilian Lignocellulosic Wastes for Bioenergy Production: Characterization and Comparison with Fossil Fuels," BioResources 8(1), 1166-1185 (Year: 2013).

Co-pending U.S. Appl. No. 15/816,392, filed Nov. 17, 2017, by Rouse et al. for "Hesperaloe Tissue Having Improved Cross-Machine Direction Properties."

(Continued)

*Primary Examiner* — Jose A Fortuna

(74) *Attorney, Agent, or Firm* — Kimberly-Clark Worldwide, Inc.

(57) ABSTRACT

The invention provides tissue products comprising hesperaloe fibers and having satisfactory strength in-use and good dispersibility. To produce the instant tissue products the inventors have successfully moderated the changes in strength and stiffness typically associated with substituting conventional wood papermaking fibers, such as NSWK, with hesperaloe fibers. Not only have the inventors succeeded in moderating changes to strength and stiffness they have improved dispersibility. As such, the tissue products of the present invention have properties comparable to, or better than, those produced using conventional papermaking fibers, such as wood pulp fibers.

20 Claims, 1 Drawing Sheet

(56) References Cited

U.S. PATENT DOCUMENTS

| | | | | |
|---|---|---|---|---|
| 2018/0142419 | A1* | 5/2018 | Rouse | D21H 27/005 |
| 2018/0142420 | A1* | 5/2018 | Rouse | D21H 27/005 |
| 2018/0142421 | A1* | 5/2018 | Rouse | D21H 27/005 |
| 2019/0100878 | A1* | 4/2019 | Shannon | A47K 7/00 |
| 2019/0100883 | A1* | 4/2019 | Shannon | D21H 27/002 |

FOREIGN PATENT DOCUMENTS

| | | | |
|---|---|---|---|
| MX | 2010001159 | A | 7/2011 |
| WO | 16195625 | A1 | 12/2016 |
| WO | 16195627 | A1 | 12/2016 |
| WO | 16195629 | A1 | 12/2016 |

OTHER PUBLICATIONS

Co-pending U.S. Appl. No. 15/816,422, filed Nov. 17, 2017, by Rouse et al. for "High Strength and Low Stiffness Hesperaloe Tissue."

Co-pending U.S. Appl. No. 15/574,321, filed Nov. 15, 2017, by Shannon et al. for "SOFT Tissue Comprising Non-Wood Fibers."

Co-pending U.S. Appl. No. 15/574,331, filed Nov. 15, 2017, by Shannon et al. for "Highly Durable Towel Comprising Non-Wood Fibers."

Co-pending U.S. Appl. No. 15/574,312, filed Nov. 15, 2017, by Collins et al. for "High Bulk Hesperaloe Tissue."

* cited by examiner

HIGHLY DISPERSIBLE HESPERALOE TISSUE

RELATED APPLICATIONS

The present application is related to and claims the benefit of U.S. Provisional Application No. 62/425,651 filed Nov. 23, 2016, the contents of which are incorporated herein by reference in a manner consistent with the instant application.

BACKGROUND OF THE DISCLOSURE

Dispersible wiping products, such as dry toilet tissue and moist wipes, are generally intended to be used and then flushed down a toilet. Accordingly, it is desirable for such flushable moist wipes to have an in-use strength sufficient to withstand a user's extraction of the wipe from a dispenser and the user's wiping activity, but then relatively quickly breakdown and disperse in household and municipal sanitization systems, such as sewer or septic systems. Some municipalities may define "flushable" through various regulations. Flushable moist wipes must meet these regulations to allow for compatibility with home plumbing fixtures and drain lines, as well as the disposal of the product in onsite and municipal wastewater treatment systems.

One challenge for some known flushable moist wipes is that it takes a relatively longer time for them to break down in a sanitation system as compared to conventional, dry toilet tissue thereby creating a risk of blockage in toilets, drainage pipes, and water conveyance and treatment systems. Dry toilet tissue typically exhibits lower post-use strength upon exposure to tap water, whereas some known flushable moist wipes require a relatively long period of time and/or significant agitation within tap water for their post-use strength to decrease sufficiently to allow them to disperse. Attempts to address this issue, such as making the wipes to disperse more quickly, may reduce the in-use strength of the flushable moist wipes below a minimum level deemed acceptable by users.

Thus, there is a need to provide a wiping product that provides an in-use strength expected by consumers, disperses sufficiently quickly to be flushable without creating potential problems for household and municipal sanitation systems, and is cost-effective to produce.

SUMMARY OF THE DISCLOSURE

The present inventors have successfully used hesperaloe fibers to produce a tissue having satisfactory strength in-use and good dispersibility. To produce the instant tissue products the inventors have successfully moderated the changes in strength and stiffness typically associated with substituting conventional papermaking fibers, such as Northern softwood kraft (NSWK), with hesperaloe fibers. Not only have the inventors succeeded in moderating changes to strength and stiffness they have improved dispersibility. As such, the tissue products of the present invention have properties comparable to, or better than, those produced using conventional papermaking fibers, such as wood pulp fibers.

Accordingly, in certain embodiments, the invention provides tissue products comprising at least 5 percent, by weight of the tissue product, hesperaloe fibers, the tissue product having good dry durability, such as a Dry Durability Index greater than about 30 and more preferably greater than about 35 and still more preferably greater than about 38, and good dispersibility, such as a slosh box break up time less than about 100 seconds, more preferably less than about 80 seconds, and still more preferably less than about 60 seconds, such as from about 20 to about 100 seconds and more preferably from about 20 to about 40 seconds.

In still other embodiments the present invention provides a tissue product comprising at least 5 percent, by weight of the tissue product, hesperaloe fibers, the product having improved cross-machine direction (CD) properties, such as a CD Stretch greater than about 10 percent, and more preferably greater than about 12 percent, a CD tensile strength greater than about 400 g/3" and a CD TEA greater than about 5.0 g·cm/cm$^2$. The foregoing tissue products generally retain a modest amount of CD tensile strength when wet, such as a Wet CD tensile greater than about 70 g/3" and more preferably greater than about 80 g/3" and still more preferably greater than about 100 g/3".

In another embodiment the present invention provides a tissue product comprising at least one through-air dried tissue web, the web comprising at least about 5 weight percent hesperaloe fiber, the tissue product having a GMT less than about 1,000 g/3", a Wet CD Durability greater than about 7.0, more preferably greater than about 7.5 and still more preferably greater than about 8.0 and a slosh box break up time less than about 50 seconds.

In other embodiments the present invention provides a nonwoven tissue product comprising at least one nonwoven web, the web comprising at least 5 percent, by weight of the tissue product, hesperaloe fibers, the product having a basis weight from about 20 to about 200 grams per square meter (gsm), a Wet CD Durability greater than about 10.0, more preferably greater than about 12.0 and still more preferably greater than about 14.0 and a slosh box break up time less than about 100 seconds.

In yet other embodiments the present invention provides a nonwoven web, comprising at least 5 percent, by weight of the web, hesperaloe fibers, less than about 20 percent, by weight of the web, staple fiber, wherein the nonwoven web comprises no binder, adhesive or thermal bonding fiber, the product having a basis weight from about 20 to about 200 grams per square meter (gsm), a Wet CD Durability greater than about 10.0, more preferably greater than about 12.0 and still more preferably greater than about 14.0 and a slosh box break up time less than about 100 seconds.

In other embodiments the present invention provides a process for producing a dispersible nonwoven web, the process comprising the steps of forming a fiber slurry comprising at least about 5 percent, by weight of slurry, high yield hesperaloe fiber, depositing the fiber slurry on a foraminous support; impinging water upon the fiber slurry; entangling the fibers to form a coherent nonwoven web, and drying the nonwoven web.

DEFINITIONS

Figure 1:
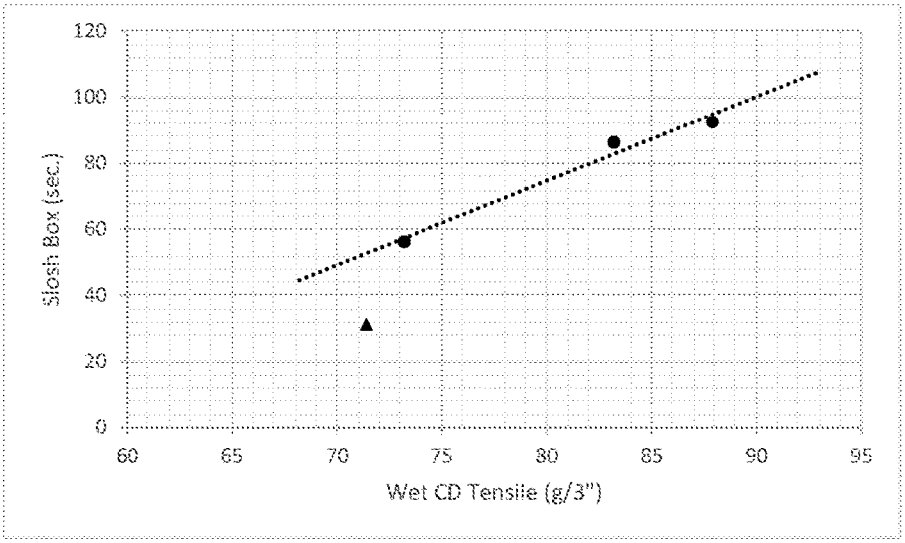
FIG. 1 is a graph illustrating the relationship between wet CD tensile strength and slosh-box break-up time for a control tissue product (●) and a tissue product comprising 40 percent, by weight, high yield hesperaloe fiber (▲)
Figure 2:
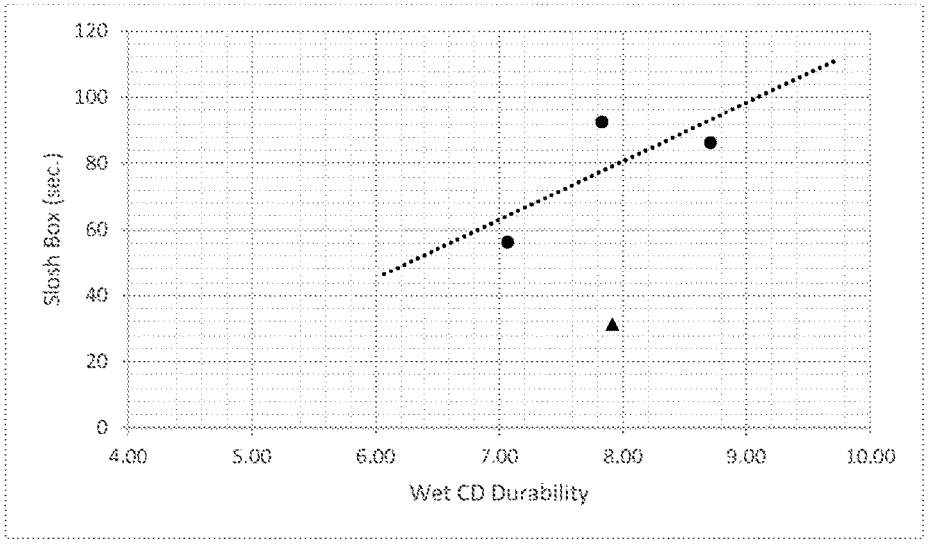
FIG. 2 is a graph illustrating the relationship between wet CD durability index and slosh-box break-up time for a control tissue product (●) and a tissue product comprising 40 percent, by weight, high yield hesperaloe fiber (▲).

As used herein, a "Tissue Product" generally refers to various paper products, such as facial tissue, bath tissue, paper towels, napkins, and the like. Normally, the basis weight of a tissue product of the present invention is less than about 200 grams per square meter (gsm), in some embodiments less than about 100 gsm, and in some embodiments from about 10 to about 200 gsm and more preferably from about 20 to about 100 gsm.

As used herein, the term "Layer" refers to a plurality of strata of fibers, chemical treatments, or the like, within a ply.

As used herein, the terms "Layered Tissue Web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

The term "Ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "Basis Weight" generally refers to the bone dry weight per unit area of a tissue and is generally expressed as grams per square meter (gsm). Basis weight is measured using TAPPI test method T-220.

As used herein, the term "Dry Burst Index" refers to the dry burst peak load (typically having units of grams) at a relative geometric mean tensile strength (typically having units of grams per three inches) as defined by the equation:

$$\text{Dry Burst Index} = \frac{\text{Dry Burst Peak Load}\,(gf)}{GMT\,(\text{g}/3'')} \times 10$$

While the Dry Burst Index may vary, tissue products prepared according to the present disclosure may, in certain embodiments, have a Dry Burst Index greater than about 8.0, more preferably greater than about 9.0 and still more preferably greater than about 10.0, such as from about 8.0 to about 12.0 and more preferably from about 9.0 to about 12.0.

As used herein, the term "Dry TEA Index" refers to the dry geometric mean tensile energy absorption (typically expressed in g·cm/cm$^2$) at a given geometric mean tensile strength (typically having units of grams per three inches) as defined by the equation:

$$\text{Dry } TEA \text{ Index} = \frac{GM\ TEA\,(\text{g}\cdot\text{cm/cm2})}{GMT\,(\text{g}/3'')} \times 1{,}000$$

While the Dry TEA Index may vary, tissue products prepared according to the present disclosure may, in certain embodiments, have a Dry TEA Index greater than about 10.0, more preferably greater than about 10.5 and still more preferably greater than about 11.0, such as from about 10.0 to about 14.0 and more preferably from about 11.0 to about 14.0.

As used herein, the term "Dry Tear Index" refers to the dry GM Tear Strength (typically expressed in grams) at a relative geometric mean tensile strength (typically having units of grams per three inches) as defined by the equation:

$$\text{Dry Tear Index} = \frac{GM\ \text{Tear (g)}}{GMT\,(\text{g}/3'')} \times 1{,}000$$

While the Dry Tear Index may vary, tissue products prepared according to the present disclosure may, in certain embodiments, have a Dry Tear Index greater than about 17.0, more preferably greater than about 18.0 and still more preferably greater than about 18.5.

As used herein, the term "Dry Durability Index" refers to the sum of the Dry Tear Index, the Dry Burst Index, and the Dry TEA Index and is an indication of the durability of the product at a given tensile strength.

Durability Index=Dry Tear Index+Dry Burst Index+Dry TEA Index

While the Dry Durability Index may vary, tissue products prepared according to the present disclosure may, in certain embodiments, have a Dry Durability Index value greater than about 38, more preferably greater than about 39 and still more preferably greater than about 40.

As used herein, the term "Wet Burst Index" refers to the quotient of the Wet Burst Strength divided by the bone dry basis weight (gsm):

$$\text{Wet Burst Index} = \frac{\text{Wet Burst Strength}}{\text{Basis Weight}}$$

Generally tissue products prepared according to the present invention have a Wet Burst Strength greater than about 100 gf, more preferably greater than about 115 gf and still more preferably greater than about 120 gf. While Wet Burst Index may vary depending on the composition of the tissue web, as well as the basis weight of the web, webs prepared according to the present disclosure generally have a Wet Burst Index greater than 3.0 and more preferably greater than about 3.5.

As used herein, the term "Wet CD TEA Index" refers to the quotient of the Wet CD TEA (g·cm/cm$^2$) divided by the bone dry basis weight (gsm) multiplied by 100:

$$\text{Wet } CD\ TEA \text{ Index} = \frac{\text{Wet } CD\ TEA}{\text{Basis Weight}} \times 100$$

As used herein, the term "Wet CD Tensile Index" refers to the quotient of the Wet CD Tensile (g/3") divided by the bone dry basis weight (gsm):

$$\text{Wet } CD \text{ Tensile Index} = \frac{\text{Wet } CD \text{ Tensile}}{\text{Basis Weight}}$$

As used herein, the term "Wet Durability Index" refers to the sum of the Wet CD Tensile Index, Wet Burst Index and Wet TEA Index and is an indication of the wet durability of the product:

Wet Durability Index=Wet CD Tensile Index+Wet Burst Index+Wet TEA Index

While the Wet Durability Index may vary depending on the composition of the tissue web, as well as the basis weight of the web, webs and products prepared according to the present disclosure generally have a Wet Durability Index greater than about 7.0, more preferably greater than about 7.5 and still more preferably greater than about 8.0.

As used herein, the term "Caliper" is the representative thickness of a single sheet (caliper of tissue products comprising one or more plies is the thickness of a single sheet of tissue product comprising all plies) measured in accordance with TAPPI test method T402 using a ProGage 500 Thickness Tester (Thwing-Albert Instrument Company, West Berlin, N.J.). The micrometer has an anvil diameter of 2.22 inches (56.4 mm) and an anvil pressure of 132 grams per square inch (per 6.45 square centimeters) (2.0 kPa).

As used herein, the term "Sheet Bulk" refers to the quotient of the caliper (μm) divided by the bone dry basis weight (gsm). The resulting sheet bulk is expressed in cubic centimeters per gram (cc/g). Tissue products prepared according to the present invention may, in certain embodiments, have a sheet bulk greater than about 10 cc/g, more preferably greater than about 11 cc/g and still more preferably greater than about 12 cc/g.

As used herein, the term "Fiber Length" refers to the length weighted average length (LWAFL) of fibers determined utilizing an OpTest Fiber Quality Analyzer-360 (OpTest Equipment, Inc., Hawkesbury, ON). The length weighted average length is determined in accordance with the manufacturer's instructions and generally involves first accurately weighing a pulp sample (10-20 mg for hardwood, 25-50 mg for softwood) taken from a one-gram handsheet made from the pulp. The moisture content of the handsheet should be accurately known so that the actual amount of fiber in the sample is known. This weighed sample is then diluted to a known consistency (between about 2 and about 10 mg/I) and a known volume (usually 200 ml) of the diluted pulp is sampled. This 200 ml sample is further diluted to 600 ml and placed in the analyzer. The length-weighted average fiber length is defined as the sum of the product of the number of fibers measured and the length of each fiber squared divided by the sum of the product of the number of fibers measured and the length of the fiber. Fiber lengths are generally reported in millimeters.

As used herein, the term "Coarseness" generally refers to the weight per unit length of fiber, commonly having units of mg/100 meters. Coarseness is measured according to ISO Coarseness Testing Method 23713 utilizing an OpTest Fiber Quality Analyzer-360 (OpTest Equipment, Inc., Hawkesbury, ON).

As used herein, the term "Hesperaloe Fiber" refers to a fiber derived from a plant of the genus *Hesperaloe* of the family Asparagaceae including, for example, *H. funifera, H. parviflora, H. nocturna, H. chiangii, H. tenuifolia, H. engelmannii*, and *H. malacophylla*. The fibers are generally processed into a pulp for use in the manufacture of tissue products according to the present invention. Preferably the pulping process is a high yield pulping process, such as a pulping process having a yield greater than about 60 percent, such as from about 60 to about 90 percent and more preferably from about 65 to about 90 percent. The foregoing yields generally refer to the yield of unbleached hesperaloe fiber.

As used herein, the term "Slope" refers to the slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width.

As used herein, the term "Geometric Mean Slope" (GM Slope) generally refers to the square root of the product of machine direction slope and cross-machine direction slope.

As used herein, the terms "Geometric Mean Tensile" (GMT) refer to the square root of the product of the machine direction tensile strength and the cross-machine direction tensile strength of the web. While the GMT may vary, tissue products prepared according to the present disclosure may, in certain embodiments, have a GMT less than about 1,000 g/3".

As used herein, the term "Stiffness Index" refers to the quotient of the geometric mean tensile slope, defined as the square root of the product of the machine direction (MD) and cross-machine direction (CD) slopes (typically having units of kg), divided by the geometric mean tensile strength (typically having units of grams per three inches).

$$\text{Stiffness Index} = \frac{\sqrt{MD\ \text{Tensile Slope (kg)} \times CD\ \text{Tensile Slope (kg)}}}{GMT\ (\text{g}/3'')} \times 1{,}0000$$

While the Stiffness Index may vary, tissue products prepared according to the present disclosure may, in certain embodiments, have a Stiffness Index less than about 8.0, more preferably less than about 7.0 and still more preferably less than about 6.5.

DETAILED DESCRIPTION OF THE DISCLOSURE

Generally the skilled tissue maker is concerned with balancing various tissue properties such as bulk, softness, stiffness and strength. For example, the tissue maker often desires to increase bulk without stiffening the tissue product or reducing softness, while at the same time maintaining a given tensile strength. Previous attempts to manufacture tissue using hesperaloe fibers have not successfully balanced these important tissue properties resulting in reduced bulk with dramatic increases in tensile and stiffness. Despite the failings of the prior art, the present inventors have now succeeded in moderating the changes in strength and stiffness without negatively effecting bulk when manufacturing a tissue product comprising hesperaloe fibers, as illustrated in Table 1, below.

TABLE 1

| Example | Furnish | Delta Bulk | Delta GMT | Delta GM Slope |
|---|---|---|---|---|
| U.S. Pat. No. 5,320,710 | 50% *H. Funifera*<br>50% NSWK | −20% | 192% | 65% |
| Inventive | 40% *H. Funifera*<br>60% EHWK | 23% | 13% | 15% |

Not only were previous attempts to balance bulk, strength, stiffness and softness unsuccessful, the resulting tissue products were not suitable for use as premium bath tissue because the strengths and modulus were excessively high. For example, when compared to Northern® Bathroom Tissue the inventive code of U.S. Pat. No. 5,320,710 had 11 percent lower bulk, 23 percent greater modulus and 148 percent greater stiffness (measured as the modulus divided by the tensile strength). The present inventors have overcome these failings to provide a tissue product that is comparable or better than commercially available bath tissue products. For example, the tissue products of the present invention have comparable or better physical properties than currently available commercial products, as illustrated in Table 2, below.

TABLE 2

| Product | Plies | Sheet Bulk (cc/g) | GMT (g/3") | CD Stretch (%) | GM Tear (gf) | Wet CD Tensile (g/3") | Wet Burst (gf) | Slosh Box (sec) |
|---|---|---|---|---|---|---|---|---|
| Charmin ® Basic (2015) | 1 | 10.8 | 1028 | 8.8 | 18.5 | 111 | 149 | 91.6 |
| Charmin ® Ultra Strong (2015) | 2 | 13.3 | 1149 | 10.5 | 24.1 | 151 | 198 | 54.6 |
| Northern ® Ultra Soft&Strong (2015) | 2 | 11.6 | 826 | 8.2 | 18.2 | 100 | 122 | 67.5 |
| Cottonelle ® Clean Care | 1 | 11.6 | 787 | 8.7 | 14.4 | 99 | 126 | 49 |
| Inventive | 1 | 17.5 | 882 | 11.3 | 17.7 | 71 | 128 | 31.3 |

Without being bound by any particular theory, the high degree of strength and stiffness observed previously in tissue products may be attributed in-part to the morphology of hesperaloe fiber when prepared by chemical pulping, which has a relatively long fiber length, high aspect ratio and high ratio of fiber length to cell wall thickness. A comparison of the morphology of hesperaloe kraft pulp fibers and conventional papermaking pulp fibers, as reported previously in U.S. Pat. No. 5,320,710, is provided in Table 3, below.

TABLE 3

| Fiber | Fiber Length (mm) | Coarseness (mg/100 m) |
|---|---|---|
| *H. Funifera* kraft pulp | 2.96 | 8.0 |
| NSWK | 2.92 | 14.2 |
| SSWK | 3.46 | 26.7 |
| EHWK | 0.99 | 7.6 |

The present inventors have now discovered that hesperaloe fibers processed by high yield pulping means, such as mechanical pulping, may overcome the limitations of kraft hesperaloe pulp fibers. Moreover, high yield hesperaloe fibers may be a suitable replacement for softwood kraft fibers without decreasing bulk, significantly altering tensile, increasing stiffness or reducing softness. As such, the tissue webs and products of the present invention generally comprise at least about 5 percent, by weight of the web or product, and more preferably at least about 10 percent and still more preferably at least about 15 percent, such as from about 5 to about 50 percent, and more preferably from about 20 to about 50 percent, such as from about 20 to about 40 percent, high yield hesperaloe fiber.

High yield pulping processes useful for the manufacture of high yield hesperaloe pulps include, for example, mechanical pulp (MP), refiner mechanical pulp (RMP), pressurized refiner mechanical pulp (PRMP), thermomechanical pulp (TMP), high temperature TMP (HT-TMP), RTS-TMP, thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW) or any modifications and combinations thereof. Processing of hesperaloe fibers using a high yield pulping process generally results in a pulp having a yield of at least about 60 percent, more preferably at least about 65 percent and still more preferably at least about 75 percent, such as from about 60 to about 95 percent and more preferably from about 65 to about 90 percent. The foregoing yields refer to the yield of unbleached hesperaloe pulp.

The high yield pulping process may comprise heating the hesperaloe fiber above ambient, such as from about 70 to about 200° C., and more preferably from about 90 to about 150° C. while subjecting the fiber to mechanical forces. Caustic or an oxidizing agent may be introduced to the process to facilitate fiber separation by the mechanical forces. For example, in one embodiment, a solution of 3 to about 8 percent NaOH and a solution of 3 to about 8 percent peroxide may be added to the fiber during mechanical treatment to facilitate fiber separation.

In other embodiments the high yield pulping process may comprise treating hesperaloe leaves with an alkaline pulping solution such as that disclosed in U.S. Pat. No. 6,302,997, the contents of which are incorporated herein in a manner consistent with the present disclosure. Alkaline treatment may be carried out at a pressure from about atmospheric pressure to about 30 psig and at a temperature ranging from about ambient temperature to about 150° C. The alkaline hydroxide may be added, based upon the oven dried mass of the hesperaloe leaves, from about 10 to about 30 percent. Suitable alkaline pulping solutions include, for example, sodium hydroxide, potassium hydroxide, ammonium hydroxide, calcium hydroxide, and combinations thereof. After alkaline treatment, the hesperaloe is mechanically worked and then treated with an acid solution to reduce the pH to an acid pH.

In other embodiments the high yield pulping process may comprise impregnating hesperaloe leaves with a solution of nitric acid and optionally ammonium hydroxide at ambient temperatures under atmospheric pressure, such as described in U.S. Pat. No. 7,396,434, the contents of which are incorporated herein in a manner consistent with the present invention. The impregnated leaves are then heated to evaporate the nitric acid followed by treatment with an alkaline solution before being cooled.

Although a caustic, such as NaOH, or oxidizing agent, such as nitric acid or peroxide, may be added during processing, it is generally preferred that the hesperaloe fiber is not pretreated with a sodium sulfite or the like prior to processing. For example, high yield hesperaloe pulps are generally prepared without pretreatment of the fiber with an aqueous solution of sodium sulfite, or the like, which is commonly employed in the manufacture of chemi-mechanical wood pulps.

High yield hesperaloe pulp may be used to manufacture tissue products according to the present invention by any number of different methods known in the art. In one example, the method comprises the steps of (a) forming an embryonic fibrous web comprising high yield hesperaloe pulp, (b) molding the embryonic web using a molding member, such as a three-dimensional papermaking belt and (c) drying the web. The embryonic web can be formed and dried in a wet-laid process using a conventional process, conventional wet-press, through-air drying process, fabric-creping process, belt-creping process, or the like. When forming multi-ply tissue products, the separate plies can be made from the same process or from different processes as desired.

In particularly preferred embodiments tissue webs comprising hesperaloe fibers are formed by through-air drying and can be either creped or uncreped. For example, the present invention may utilize the papermaking process disclosed in U.S. Pat. Nos. 5,656,132 and 6,017,417, which are incorporated herein in a manner consistent with the present disclosure. The embryonic fibrous web is formed using a twin wire former having a papermaking headbox that injects or deposits a furnish of an aqueous suspension of papermaking fibers onto a plurality of forming fabrics, such as the outer forming fabric and the inner forming fabric, thereby forming a wet tissue web. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of greater than 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.).

The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross-machine (CD) or machine direction (MD) (expressed as percent elongation at sample failure). For example, the relative speed difference between the two fabrics can be from about 1 to about 45 percent, in some embodiments from about 5 to about 30 percent, and in some embodiments, from about 15 to about 28 percent. This is commonly referred to as "rush transfer." During "rush transfer," many of the bonds of the web are believed to be broken, thereby forcing the sheet to bend and fold into the depressions on the surface of the transfer fabric. Such molding to the contours of the surface of the transfer fabric may increase the MD and CD stretch of the web.

The wet tissue web is then transferred from the transfer fabric to a through-air drying fabric. Typically, the transfer fabric travels at approximately the same speed as the through-air drying fabric. However, a second rush transfer may be performed as the web is transferred from the transfer fabric to the through-air drying fabric. This rush transfer is referred to as occurring at the second position and is achieved by operating the through-air drying fabric at a slower speed than the transfer fabric.

While supported by a through-air drying fabric, the wet tissue web is dried to a final consistency of about 94 percent or greater by a through-air dryer. The web then passes through the winding nip between the reel drum and the reel and is wound into a roll of tissue for subsequent converting.

In other embodiments the embryonic fibrous structure is formed by a wet-laid forming section and transferred to a through-air drying fabric with the aid of vacuum air. The embryonic fibrous structure is molded to the through-air drying fabric and partially dried to a consistency of about 40 to about 70 percent with a through-air dried process. The partially dried web is then transferred to the surface of a cylindrical dryer, such as a Yankee dryer, by a pressure roll. The web is pressed and adhered onto the Yankee dryer surface having a coating of creping adhesive. The fibrous structure is dried on the Yankee surface to a moisture level of about 1 to about 5 percent moisture where it is separated from the Yankee surface with a creping process. The creping blade bevel can be from 15 to about 45 percent with the final impact angle from about 70 to about 105 degrees.

In still other embodiments the tissue product may comprise a nonwoven web. Nonwoven webs useful in the present invention generally comprise individual fibers or filaments randomly arranged in a mat-like fashion. Nonwoven fabrics may be made from a variety of processes including, but not limited to, airlaid processes, wet-laid processes such as with cellulosic-based tissues or towels, hydroentangling processes, staple fiber carding and bonding, and solution spinning.

The fibrous material used to form the nonwoven web may desirably have a relatively low wet cohesive strength prior to its treatment with the binder composition. Thus, when the fibrous substrate is bonded together by the binder composition, the nonwoven web will preferably break apart when it is placed in water, such as that found in toilets and sinks.

The fibers forming nonwoven webs may be made from a variety of materials including natural fibers, synthetic fibers, and combinations thereof. The choice of fibers may depend upon, for example, the intended end use of the finished substrate, as well as the fiber cost. For instance, suitable fibers may include, but are not limited to, wood pulp fibers. Similarly, suitable fibers may also include, but are not limited to, regenerated cellulosic fibers, such as viscose rayon and cuprammonium rayon; modified cellulosic fibers, such as cellulose acetate; or synthetic fibers, such as those derived from polypropylenes, polyethylenes, polyolefins, polyesters, polyamides, polyacrylics, etc. Regenerated cellulose fibers, as briefly discussed above, include rayon in all its varieties as well as other fibers derived from viscose or chemically modified cellulose, including regenerated cellulose and solvent-spun cellulose, such as Lyocell.

In addition to the foregoing fibers, the nonwoven webs comprise at least about 5 percent, by weight, hesperaloe fiber, such as from about 5 to about 50 percent, and more preferably from about 10 to about 40 percent and still more preferably from about 15 to about 30 percent. The hesperaloe fiber may substitute any other fiber typically used in the manufacture of nonwoven webs, but preferably it substitutes long average fiber length wood pulp fibers, such as NSWK, synthetic fibers, such as those derived from polypropylenes, polyethylenes, polyolefins, polyesters, polyamides, polyacrylics, or regenerated cellulose fibers. In certain embodiments the hesperaloe fiber may entirely replace substantially all of the synthetic fibers or regenerated cellulose fibers in the nonwoven basesheet.

Nonwoven webs, such as airlaid and hydroentangled webs prepared according to the present disclosure, are particularly well suited for use as wet wipes. The basis weights for nonwoven webs may range from about 20 to about 200 gsm more preferably from about 20 to about 150 gsm, and still more preferably from 30 to about 90 gsm or about 50 to about 60 gsm.

Webs, prepared as described above, may be incorporated into tissue products comprising a single or multiple pies, such as two, three or four plies. The products may be subjected to further processing including, but not limited to, printing, embossing, calendering, slitting, folding, combining with other fibrous structures, and the like.

In certain embodiments the invention provides wet-laid tissue products having a basis weight greater than about 10 grams per square meter (gsm), for example from about 10 to about 100 gsm and more specifically from about 20 to about 80 gsm and more preferably from about 30 to about 60 gsm. In certain embodiments the present disclosure provides a single-ply through-air dried tissue product having a basis weight from about 30 to about 60 gsm. At the foregoing basis weights tissue products prepared according to the present disclosure have geometric mean tensile (GMT) less than about 1,000 g/3", such as from about 450 to about 1,000 g/3" and more specifically from about 700 to about 1,000 g/3".

Regardless of how the webs are converted to tissue products, the products of the present invention generally comprise at least about 5 percent, and more preferably at least about 10 percent, and still more preferably at least about 20 percent, by weight of the product, high yield hesperaloe fiber. In certain preferred embodiments hesperaloe fiber may replace all or a portion of the long fiber fraction of the papermaking furnish, such as Northern softwood kraft (NSWK) or Southern softwood kraft (SSWK). Accordingly, in certain embodiments, hesperaloe fibers may replace at least about 50 percent of the NSWK or SSWK in the tissue product, more preferably at least about 75 percent and still more preferably all NSWK or SSWK. In certain embodiments replacement of all or a portion of the long fiber fraction of the papermaking furnish with hesperaloe fiber may be accomplished without negatively effecting the tissue product's softness and durability.

In still other embodiments single- or multi-ply tissue products may be formed from one or more multi-layered plies having hesperaloe fibers selectively incorporated in one of its layers. For example, the tissue product may comprise two multi-layered through-air dried webs wherein each web comprises a first fibrous layer substantially free from hesperaloe fibers and a second fibrous layer comprising hesperaloe fibers. The webs are plied together such that the outer surface of the tissue product is formed from the first fibrous layer of each web and the second fibrous layer comprising the hesperaloe fibers is not brought into contact with the users skin in-use.

The ability to substitute the long fiber fraction of the papermaking furnish with hesperaloe fiber without negatively affecting important tissue properties is highlighted in Table 4, below. All tissues shown in Table 4 are single-ply tissue products having a basis weight of about 35 gsm and comprising either 40 weight percent NSWK or hesperaloe and 60 weight percent EHWK, based upon the total weight of the tissue product. Surprisingly substituting NSWK with hesperaloe provides improved durability without stiffening or dramatically increasing tensile strength.

TABLE 4

| | NSWK | High Yield Hesperaloe Fiber | Delta |
|---|---|---|---|
| GMT (g/3") | 790 | 925 | 17% |
| GM Tear (g) | 12.2 | 17.7 | 45% |
| CD Stretch (%) | 10.1 | 11.3 | 12% |
| Dry Durability Index | 35.3 | 39.9 | 13% |
| Stiffness Index | 6.21 | 6.12 | −1% |
| Wet Burst (gf) | 114 | 128 | 12% |
| Wet Durability Index | 7.83 | 7.91 | 1% |
| Slosh Box (sec) | 92.5 | 31.3 | −66% |

Accordingly, in certain embodiments the present invention provides tissue products that are not only soft, but also highly durable at relatively modest tensile strengths. As such, in certain embodiments, the invention provides a wet-laid tissue product comprising at least about 5 percent, by weight of the product, high yield hesperaloe fiber, the product having a basis weight from about 15 to about 60 gsm, a GMT less than about 1,000 g/3", such as from about 400 to about 1,000 g/3", and more preferably from about 500 to about 800 g/3", but still have a Dry Durability Index greater than about 35 and more preferably greater than about 38 and still more preferably greater than about 40.

In other embodiments the tissue products have a Stiffness Index less than about 10.0 and more preferably less than about 8.0 and still more preferably less than about 7.0, and a Dry Durability Index greater than about 30 and more preferably greater than about 35 and still more preferably greater than about 38. In one particularly preferred embodiment the tissue product comprises a through-air dried web comprising less than about 5 weight percent NSWK, and from about 10 to about 40 weight percent hesperaloe fiber, the tissue product having a Dry Durability Index from about 35 to about 40 and a Stiffness Index from about 4.0 to about 8.0.

In addition to having improved durability and relatively modest tensile strength, the instant tissue products have favorable CD properties, such as a CD stretch greater than about 10.0 percent, such as from about 10.0 to about 14.0 percent. Generally, at the foregoing levels of CD stretch the tissue products also have relatively high CD tensile strength, such as greater than about 450 g/3", such as from about 450 to about 800 g/3". In a particularly preferred embodiment the tissue products have a CD stretch from about 10.0 to about 12.0 percent and a CD tensile strength from about 500 to about 700 g/3". At these levels of CD tensile strength and CD stretch the tissue products of the present disclosure are highly durable, particularly in what is generally the weakest orientation of the tissue product—the cross machine direction. Accordingly, tissue products of the present disclosure generally withstand use better than prior art tissue products.

In still other embodiments the present invention provides a tissue product comprising at least about 5 percent, by weight of the tissue product, high yield hesperaloe, the product having a GMT less than about 1,000 g/3", a CD Stretch greater than about 10 percent and more preferably greater than about 12 percent. In addition to having improved stretch, the foregoing tissue may also have improved CD TEA, such as a CD TEA greater than about 5.0 and more preferably greater than about 6.0 and still more preferable greater than about 6.5 g·cm/cm$^2$.

As noted elsewhere throughout this disclosure, the combination high yield hesperaloe fibers and conventional papermaking fibers, such as wood pulp fibers, create tissue products, such as dry bath tissue and wet wipes, having good dispersibility and durability. The dispersibility of the dispersible moist wipes can be measured using a slosh box test, as detailed in the Test Methods section of this disclosure. In some embodiments of the present disclosure, tissue products of the present disclosure have a slosh box break up time of less than about 100 seconds. In other embodiments, the tissue products have a slosh box break up time of from about 30 to about 100 seconds and more preferably from about 30 to about 60 seconds and still more preferably from about 30 to about 40 seconds.

In yet other embodiments tissue prepared according to the present invention may have good dispersibility while also having good wet durability. Accordingly, the invention provides a tissue product comprising at least about 5 percent, by weight of the product, hesperaloe fiber, wherein the product has a basis weight from about 10 to about 200 gsm, such as from about 20 to about 120 gsm and more preferably from about 30 to about 100 gsm, and a slosh box break up time of less than about 120 seconds and more preferably less than about 100 seconds, more preferably less than about 80 seconds, and still more preferably less than about 50 seconds, and a Wet Durability Index greater than about 7.0 and more preferably greater than about 7.5 and still more preferably greater than about 8.0.

TEST METHODS

Sheet Bulk

Sheet Bulk is calculated as the quotient of the dry sheet caliper (μm) divided by the bone dry basis weight (gsm). Dry sheet caliper is the measurement of the thickness of a single sheet of tissue product (comprising all plies) measured in accordance with TAPPI test method T402 using a ProGage 500 Thickness Tester (Thwing-Albert Instrument Company, West Berlin, N.J.). The micrometer has an anvil diameter of 2.22 inches (56.4 mm) and an anvil pressure of 132 grams per square inch (per 6.45 square centimeters) (2.0 kPa).

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63 mm±0.15 mm (2.5 inches±0.006") in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the prescribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single-ply basesheet. This is done by multiplying the single-ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3 inches±0.05 inches (76.2 mm±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm·cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a two ply product was tested as two plies and the tensile recorded as such. Alternatively, a single ply may be tested and the result multiplied by the number of plies in the final product to get the tensile strength.

Wet tensile strength measurements are measured in the same manner, but after the center portion of the previously conditioned sample strip has been saturated with distilled water and immediately prior to loading the specimen into the tensile test equipment. More specifically, prior to performing a wet CD tensile test, the sample must be aged to ensure the wet strength resin has cured. Two types of aging were practiced: natural and artificial. Natural aging was used for older samples that had already aged. Artificial aging was used for samples that were to be tested immediately after or within days of manufacture. For natural aging, the samples were held at 73° F., 50 percent relative humidity for a period of 12 days prior to testing. Following this natural aging step, the strips are then wetted individually and tested. For artificially aged samples, the 3-inch wide sample strips were heated for 4 minutes at 105±2° C. Following this artificial aging step, the strips are then wetted individually and tested. Sample wetting is performed by first laying a single test strip onto a piece of blotter paper (Fiber Mark, Reliance Basis 120). A pad is then used to wet the sample strip prior to testing. The pad is a green, Scotch-Brite brand (3M) general purpose commercial scrubbing pad. To prepare the pad for testing, a full-size pad is cut approximately 2.5 inches long by 4 inches wide. A piece of masking tape is wrapped around one of the 4-inch long edges. The taped side then becomes the "top" edge of the wetting pad. To wet a tensile strip, the tester holds the top edge of the pad and dips the bottom edge in approximately 0.25 inches of distilled water located in a wetting pan. After the end of the pad has been saturated with water, the pad is then taken from the wetting pan and the excess water is removed from the pad by lightly tapping the wet edge three times across a wire mesh screen. The wet edge of the pad is then gently placed across the sample, parallel to the width of the sample, in the approximate center of the sample strip. The pad is held in place for approximately one second and then removed and placed back into the wetting pan. The wet sample is then immediately inserted into the tensile grips so the wetted area is approximately centered between the upper and lower grips. The test strip should be centered both horizontally and vertically between the grips. (It should be noted that if any of the wetted portion comes into contact with the grip faces, the specimen must be discarded and the jaws dried off before resuming testing.) The tensile test is then performed and the peak load recorded as the CD wet tensile strength of this specimen. As with the dry CD tensile test, the characterization of a product is determined by the average of at least six, but in the case of the examples disclosed, twenty representative sample measurements.

Wet Burst Strength

Wet Burst Strength is measured using an EJA Burst Tester (series#50360, commercially available from Thwing-Albert Instrument Company, Philadelphia, Pa.). The test procedure is according to TAPPI T570 pm-00 except the test speed. The test specimen is clamped between two concentric rings whose inner diameter defines the circular area under test. A penetration assembly, the top of which is a smooth, spherical steel ball, is arranged perpendicular to and centered under the rings holding the test specimen. The penetration assembly is raised at 6 inches per minute such that the steel ball contacts and eventually penetrates the test specimen to the point of specimen rupture. The maximum force applied by the penetration assembly at the instant of specimen rupture is reported as the burst strength in grams force (gf) of the specimen.

The penetration assembly consists of a spherical penetration member which is a stainless steel ball with a diameter of 0.625±0.002 inches (15.88±0.05 mm) finished spherical to 0.00004 inches (0.001 mm). The spherical penetration member is permanently affixed to the end of a 0.375±0.010 inches (9.525±0.254 mm) solid steel rod. A 2000 gram load cell is used and 50 percent of the load range i.e. 0-1000 g is selected. The distance of travel of the probe is such that the upper most surface of the spherical ball reaches a distance of 1.375 inches (34.9 mm) above the plane of the sample clamped in the test. A means to secure the test specimen for testing consisting of upper and lower concentric rings of approximately 0.25 inches (6.4 mm) thick aluminum between which the sample is firmly held by pneumatic clamps operated under a filtered air source at 60 psi. The clamping rings are 3.50±0.01 inches (88.9±0.3 mm) in internal diameter and approximately 6.5 inches (165 mm) in outside diameter. The clamping surfaces of the clamping rings are coated with a commercial grade of neoprene approximately 0.0625 inches (1.6 mm) thick having a Shore hardness of 70-85 (A scale). The neoprene needs not cover the entire surface of the clamping ring but is coincident with the inner diameter, thus having an inner diameter of 3.50±0.01 inches (88.9±0.3 mm) and is 0.5 inches (12.7 mm) wide, thus having an external diameter of 4.5±0.01 inches (114±0.3 mm). For each test a total of 3 sheets of product are combined.

The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single ply tissue product, then 3 sheets of product totaling 3 plies are tested.

Samples are conditioned under TAPPI conditions and cut into 127×127 mm±5 mm squares. Samples are then wetted for testing with 0.5 mL of deionized water dispensed with an automated pipette. The wet sample is tested immediately after insulting.

The peak load (gf) and energy to peak (g-cm) are recorded and the process repeated for all remaining specimens. A minimum of five specimens are tested per sample and the peak load average of five tests is reported.

Dry Burst Strength

Dry burst strength herein is a measure of the ability of a fibrous structure to absorb energy, when subjected to deformation normal to the plane of the fibrous structure. Burst strength may be measured in general accordance with ASTM D-6548 with the exception that the testing is done on a Constant-Rate-of-Extension (MTS Systems Corporation, Eden Prairie, Minn.) tensile tester with a computer-based data acquisition and frame control system, where the load cell is positioned above the specimen clamp such that the penetration member is lowered into the test specimen causing it to rupture. The arrangement of the load cell and the specimen is opposite that illustrated in FIG. 1 of ASTM D-6548. The penetration assembly consists of a semi spherical anodized aluminum penetration member having a diameter of 1.588±0.005 cm affixed to an adjustable rod having a ball end socket. The test specimen is secured in a specimen clamp consisting of upper and lower concentric rings of aluminum between which the sample is held firmly by mechanical clamping during testing. The specimen clamping rings have an internal diameter of 8.89±0.03 cm.

The tensile tester is set up such that the crosshead speed is 15.2 cm/min, the probe separation is 104 mm, the break sensitivity is 60 percent and the slack compensation is 10 gf and the instrument is calibrated according to the manufacturers instructions.

Samples are conditioned under TAPPI conditions and cut into 127×127 mm±5 mm squares. For each test a total of 3 sheets of product are combined. The sheets are stacked on top of one another in a manner such that the machine direction of the sheets is aligned. Where samples comprise multiple plies, the plies are not separated for testing. In each instance the test sample comprises three sheets of product. For example, if the product is a 2-ply tissue product, three sheets of product, totaling six plies are tested. If the product is a single-ply tissue product, then three sheets of product totaling three plies are tested.

Prior to testing the height of the probe is adjusted as necessary by inserting the burst fixture into the bottom of the tensile tester and lowering the probe until it was positioned approximately 12.7 mm above the alignment plate. The length of the probe is then adjusted until it rests in the recessed area of the alignment plate when lowered.

It is recommended to use a load cell in which the majority of the peak load results fall between 10 and 90 percent of the capacity of the load cell. To determine the most appropriate load cell for testing, samples are initially tested to determine peak load. If peak load is <450 gf a 10 Newton load cell is used, if peak load is >450 gf a 50 Newton load cell is used.

Once the apparatus is set-up and a load cell selected, samples are tested by inserting the sample into the specimen clamp and clamping the test sample in place. The test sequence is then activated, causing the penetration assembly to be lowered at the rate and distance specified above. Upon rupture of the test specimen by the penetration assembly the measured resistance to penetration force is displayed and recorded. The specimen clamp is then released to remove the sample and ready the apparatus for the next test.

The peak load (gf) and energy to peak (g-cm) are recorded and the process repeated for all remaining specimens. A minimum of five specimens are tested per sample and the peak load average of five tests is reported as the Dry Burst Strength.

Slosh Box Test

This method uses a bench-scaled apparatus to evaluate the breakup or dispersibility of flushable consumer products as they travel through the wastewater collection system. In this test method, a clear plastic tank is loaded with a product and tap water or raw wastewater. The container is then moved up and down by a cam system at a specified rotational speed to simulate the movement of wastewater in the collection system. The initial breakup point and the time for dispersion of the product into pieces measuring 1 inch×1 inch (25 mm×25 mm) are recorded in the laboratory notebook. This 1 inch×1 inch (25 mm×25 mm) size is a parameter that is used because it reduces the potential of product recognition. The testing can be extended until the product is fully dispersed. The various components of the product are then screened and weighed to determine the rate and level of disintegration.

The slosh box water transport simulator consists of a transparent plastic tank that is mounted on an oscillating platform with speed and holding time controllers. The angle of incline produced by the cam system produces a water motion equivalent to 60 cm/s (2 ft/s), which is the minimum design standard for wastewater flow rate in an enclosed collection system. The rate of oscillation is controlled mechanically by the rotation of a cam and level system and should be measured periodically throughout the test. This cycle mimics the normal back-and-forth movement of wastewater as it flows through sewer pipe.

Room temperature tap water (softened and/or non-softened) or raw wastewater (2000 mL) is placed in the plastic container/tank. The timer is set for six hours (or longer) and cycle speed is set for 26 rpm. The pre-weighed product is placed in the tank and observed as it undergoes the agitation period. For toilet tissue, add a number of sheets that range in weight from 1 to 3 grams. All other products may be added whole with no more than one article per test. A minimum of one gram of test product is recommended so that adequate loss measurements can be made. The time to first breakup and full dispersion are recorded in the laboratory notebook. Note: For pre-moistened products it is recommended to flush them down the toilet and drain line apparatus prior to putting them into the slosh box apparatus or rinse them by some other means. Other pre-rinsing techniques should be described in the study records.

The test is terminated when the product reaches a dispersion point of no piece larger than 1 inch×1 inch (25 mm×25 mm) square in size or at the designated destructive sampling points. At the designated destructive sampling points, remove the clear plastic tank from the oscillating platform. Pour the entire contents of the plastic tank through a nest of screens arranged from top to bottom in the following order: 25.40 mm, 12.70 mm, 6.35 mm, 3.18 mm, 1.59 mm (diameter opening). Make sure that the perforated plate screens are set with the smooth side up. With a showerhead spray nozzle held approximately 10 to 15 cm (4 to 6 inches) above the sieve, gently rinse the material through the nested screens for two minutes at a flow rate of 4 L/min (1 gal/min) being careful not to force passage of the retained material through the next smaller screen. The flow rate can be assessed by measuring the time it takes to fill a 4 L beaker. The average of three flow rates should be 60±2 seconds. The procedure is similar to that used in the INDA/EDANA spray impact test method (WSP 80.3). After the two minutes of rinsing, remove the top screen and continue to rinse the next smaller screen, still nested, for two additional minutes. Again, be careful not to force passage of retained material to the next smaller screen. After rinsing is complete, remove the retained material from each of the screens using forceps and/or commercial paintbrushes. Transfer the content from each screen to a separate, labeled aluminum weigh pan. Place the pan in a drying oven overnight at 103±3° C. (or some other appropriate temperature depending on the thermostability of the test material). Continue this procedure at each designated sampling time until all the test products are sampled. Allow dried samples to cool down in a desiccator. After all the samples are dry, weigh the materials from each of the retained fractions and calculate the percentage of disintegration based on the initial starting weight of the test material.

EXAMPLES

Basesheets were made using a through-air dried papermaking process commonly referred to as "uncreped through-air dried" ("UCTAD") and generally described in U.S. Pat. No. 5,607,551, the contents of which are incorporated herein in a manner consistent with the present invention. Base sheets with a target bone dry basis weight of about 36 grams per square meter (gsm) were produced. The base sheets were then converted and spirally wound into rolled tissue products.

HYH pulp was produced by processing *H. Funifera* using a high yield pulping process commercially available from Phoenix Pulp and Polymer (Dayton, Wash.). The physical properties of the HYH pulp are summarized in Table 5, below. The HYH pulp was prepared by dispersing about 50 pounds (oven dry basis) HYH pulp in a pulper for 30 minutes at a consistency of about 3 percent. The fiber was then transferred to a machine chest and diluted to a consistency of 1 percent.

TABLE 5

| Fiber | Fiber Length (mm) | Average Fiber Width (μm) | Aspect Ratio | Coarseness (mg/100 m) |
|---|---|---|---|---|
| High Yield *H. Funifera* pulp | 2.5 | 19.9 | 125 | 7.3 |

In all cases the base sheets were produced from various fiber furnishes including, *Eucalyptus* hardwood kraft (EHWK) pulp, NSWK pulp, and high yield hesperaloe pulp (HYH) using a layered headbox fed by three stock chests. As such the resulting tissue webs had three layers (two outer layers and a middle layer). The two outer layers comprised EHWK (each layer comprising 30 percent weight by total weight of the web) and the middle layer comprised either NSWK or HYH. In certain instances the middle layer was refined to control the strength of the web. The composition of the webs is further described in Table 6, below.

TABLE 6

| Sample | Layer Furnish Split (outer layer/middle layer/ outer layer (wt %)) | Redibond (kg/ton)/Layer | ProSoft (kg/ton)/Layer | FennoBond (kg/ton)/Layer | Furnish Refined |
|---|---|---|---|---|---|
| Control 1 | EHWK (30)/NSWK (40)/EHWK (30) | 2/Middle | 4/Outer | 2.5/Middle | 0 |
| Control 2 | EHWK (30)/NSWK (40)/EHWK (30) | 2/Middle | 4/Outer | 2.5/Middle | Middle |
| Control 3 | EHWK (30)/NSWK (40)/EHWK (30) | 2/Middle | 4/Outer | 2.5/Middle | Middle |
| Inventive 8A | EHWK (30)/HYH (40)/EHWK (30) | — | 2/Outer | 2.5/Middle | 0 |

The formed web was non-compressively dewatered and rush transferred to a transfer fabric traveling at a speed about 28 percent slower than the forming fabric. The web was then transferred from the transfer fabric to a T-1205-2 through-drying fabric (commercially available from Voith Fabrics, Appleton, Wis., and previously disclosed in U.S. Pat. No. 8,500,955, the contents of which are incorporated herein in a manner consistent with the present disclosure) with the assistance of vacuum. The web was then dried and wound into a parent roll.

The base sheet webs were converted into bath tissue rolls. Specifically, the base sheet was calendered using a conventional polyurethane/steel calender system comprising a 40 P&J polyurethane roll on the air side of the sheet and a standard steel roll on the fabric side at a calender load of 40 pli. The calendered web was then converted into a rolled product comprising a single-ply. The finished products were subjected to physical analysis, which is summarized below. The effect of hesperaloe fibers on various tissue properties, including tensile, durability and stiffness, is summarized in Tables 7-9, below.

TABLE 7

| Sample | Basis Weight (gsm) | GMT (g/3") | CD Tensile (g/3") | CD Stretch (%) | GM TEA (g · cm/ cm$^2$) | GM Slope (kg) | GM Tear (gf) |
|---|---|---|---|---|---|---|---|
| Control 1 | 35.8 | 515 | 343 | 9.9 | 5.50 | 3.96 | 9.7 |
| Control 2 | 36.8 | 643 | 425 | 9.7 | 6.47 | 4.28 | 10.6 |
| Control 3 | 36.7 | 790 | 517 | 10.1 | 8.62 | 4.91 | 12.2 |
| Inventive 8A | 36.8 | 925 | 670 | 11.3 | 10.56 | 5.59 | 17.7 |

TABLE 8

| Sample | Wet CD Tensile (g/3") | Wet CD Stretch (%) | Wet CD TEA | Wet Burst (gf) | Wet Dry Durability Index | Slosh Box (sec) |
|---|---|---|---|---|---|---|
| Control 1 | 83.2 | 9.23 | 0.914 | 137 | 8.70 | 86.3 |
| Control 2 | 73.2 | 8.02 | 0.739 | 113 | 7.07 | 56.3 |
| Control 3 | 87.9 | 9.3 | 0.854 | 114 | 7.83 | 92.5 |
| Inventive 8A | 71.4 | 10.37 | 0.918 | 128 | 7.91 | 31.3 |

TABLE 9

| Sample | Stiffness Index | Tear Index | TEA Index | Dry Burst Index | Dry Durability Index |
|---|---|---|---|---|---|
| Control 1 | 7.73 | 18.90 | 10.69 | 9.05 | 38.64 |
| Control 2 | 6.68 | 16.41 | 10.05 | 9.01 | 35.47 |
| Control 3 | 6.21 | 15.46 | 10.91 | 8.90 | 35.27 |
| Inventive 8A | 6.12 | 19.17 | 11.41 | 9.32 | 39.90 |

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments:

In a first embodiment the present invention provides a tissue product comprising at least about 5 percent high yield hesperaloe fiber, by weight of the tissue product, the tissue product having a geometric mean tensile (GMT) less than about 1,000 g/3", a wet CD tensile greater than about 70 g/3" and a slosh box break up time less than about 100 seconds.

In a second embodiment the present invention provides the tissue product of the first embodiment having a basis weight from about 10 to about 60 gsm.

In a third embodiment the present invention provides the tissue product of the first or the second embodiments having a wet durability index greater than about 7.0.

In a fourth embodiment the present invention provides the tissue product of any one of the first through the third embodiments having a wet CD stretch greater than about 10 percent.

In a fifth embodiment the present invention provides the tissue product of any one of the first through the fourth embodiments wherein the slosh box break up time is less than about 50 seconds and still more preferably less than about 40 seconds, such as from about 20 to about 50 seconds and more preferably from about 20 to about 30 seconds.

In a sixth embodiment the present invention provides the tissue product of any one of the first through the fifth embodiments having a GMT from about 700 to about 1,000 g/3" and a Stiffness Index less than about 7.0.

In a seventh embodiment the present invention provides the tissue product of any one of the first through the sixth embodiments having a wet burst strength greater than about 100 gf.

In an eighth embodiment the present invention provides the tissue product of any one of the first through the seventh embodiments comprising from about 20 to about 50 weight percent high yield hesperaloe pulp fibers.

In a ninth embodiment the present invention provides the tissue product of any one of the first through the eighth embodiments wherein the tissue product is substantially free from softwood kraft pulp fibers.

In a tenth embodiment the present invention provides the tissue product of any one of the first through the ninth embodiments wherein the tissue product is substantially free from NSWK fibers.

In an eleventh embodiment the present invention provides a tissue product comprising at least one multi-layered through-air dried tissue web comprising a first and a second layer, the first layer being substantially free from high yield hesperaloe pulp fibers and the second layer consisting essentially of high yield hesperaloe pulp fibers, the tissue product having a GMT less than about 1,000 g/3", a wet durability index greater than about 7.0 and a slosh box break up time less than about 50 seconds.

In twelfth embodiment the present invention provides the tissue product of the eleventh embodiment having a dry burst strength 800 gf.

In a thirteenth embodiment the present invention provides the tissue product of the eleventh or twelfth embodiments having a basis weight from about 10 to about 60 gsm.

In a fourteenth embodiment the present invention provides the tissue product of any one of the eleventh through the thirteenth embodiments having a CD TEA greater than about 5.0 g·cm/cm$^2$.

In a fifteenth embodiment the present invention provides the tissue product of any one of the eleventh through the fourteenth embodiments having a wet CD tensile greater than about 70 g/3".

In a sixteenth embodiment the present invention provides a method of forming a high bulk tissue product comprising the steps of: (a) dispersing high yield hesperaloe fiber in water to form a first fiber slurry; (b) dispersing conventional wood pulp fibers in water to form a second fiber slurry; (c) depositing the first and the second fiber slurries in a layered arrangement on a moving belt to form a tissue web; (d) non-compressively drying the tissue web to yield a dried tissue web having a consistency from about 80 to about 99 percent solids; and (e) calendering the dried tissue web to yield a high bulk tissue product.

In a seventeenth embodiment the present invention provides the method of the sixteenth embodiment wherein the resulting tissue product has a basis weight from about 20 to about 60 gsm and a sheet bulk greater than about 12 cc/g.

In an eighteenth embodiment the present invention provides the method of the sixteenth or seventeenth embodiments wherein the tissue product comprises from about 5 to about 50 percent high yield hesperaloe fiber and less than about 10 percent, by weight of the tissue product, NSWK.

In a nineteenth embodiment the present invention provides the method of any one of the sixteenth through eighteenth embodiments wherein the product has a wet durability index greater than about 7.0 and a slosh box break up time less than about 50 seconds.

In a twentieth embodiment the present invention provides the method of any one of the sixteenth through nineteenth embodiments having a dry durability index greater than about 35.0.

What is claimed is:

1. A tissue product comprising from about 5 to about 50 percent, by weight of the product, high yield hesperaloe fibers, the tissue product having a geometric mean tensile (GMT) less than about 1,000 g/3", a wet CD tensile greater than about 70 g/3" and a slosh box break up time less than about 100 seconds.

2. The tissue product of claim 1 having a slosh box break up time less than about 50 seconds.

3. The tissue product of claim 1 having a dry burst strength greater than about 800 gf.

4. The tissue product of claim 1 having a CD TEA greater than about 5.0 g·cm/cm$^2$.

5. The tissue product of claim 1 having a CD tensile strength greater than about 500 g/3".

6. The tissue product of claim 1 having a wet durability index greater than about 7.0.

7. The tissue product of claim 1 having a wet burst strength greater than about 100 gf.

8. The tissue product of claim 1 having a basis weight from about 30 to about 60 grams per square meter (gsm) and a sheet bulk greater than about 10 cc/g.

9. The tissue product of claim 1 having a wet CD stretch greater than about 10 percent.

10. The tissue product of claim 1 comprising from about 20 to about 50 percent, by weight of the product, high yield hesperaloe fibers.

11. The tissue product of claim 1 wherein the tissue product comprises two plies and each ply is a through-air dried tissue web.

12. A tissue product comprising at least one multi-layered through-air dried tissue web comprising a first and a second layer, the first layer being substantially free from high yield hesperaloe pulp fibers and the second layer consisting essentially of high yield hesperaloe pulp fibers, the tissue product having a Dry Durability Index greater than about 35.0 and a slosh box break up time less than about 100 seconds, wherein the tissue product comprises from about 20 to about 50 weight percent high yield hesperaloe pulp fibers.

13. The tissue product of claim 12 having a wet CD tensile greater than about 70 g/3".

14. The tissue product of claim 12 having a wet burst strength greater than about 100 gf.

15. The tissue product of claim 12 having a basis weight from about 30 to about 60 gsm and a sheet bulk from about 10 to about 15 cc/g.

16. The tissue product of claim 12 wherein the tissue product is substantially free from softwood kraft pulp fibers.

17. A single-ply through-air dried tissue product comprising from about 5 to about 50 percent, high yield hesperaloe pulp fibers, the tissue product having a GMT less than about 1,000 g/3", a Stiffness Index less than about 10.0 and a slosh box break up time less than about 100 seconds.

18. The tissue product of claim 17 having a slosh box break up time from about 30 to about 40 seconds.

19. The tissue product of claim 17 having a dry burst strength greater than about 800 gf.

20. The tissue product of claim 17 having a CD stretch from about 8.0 to about 12.0 percent and a CD tensile strength from about 500 to about 700 g/3".

* * * * *